US005126539A

United States Patent [19]

Kim

[11] Patent Number: 5,126,539

[45] Date of Patent: Jun. 30, 1992

[54] ROLLER-TYPE BILL COUNTER WITH A DEVICE FOR REMOVING DUST

[76] Inventor: Kwang Y. Kim, Rm. No. 505, Sungdong Sangka, No. 336-2, SungSu-Dong 2Ka, Sungdon-Ku, Seoul, 133-120, Rep. of Korea

[21] Appl. No.: 658,512

[22] Filed: Feb. 21, 1991

[51] Int. Cl.[5] ..... G06M 1/00; G07F 7/04

[52] U.S. Cl. ..... 235/1 D

[58] Field of Search ..... 235/1 D, 379, 98 R, 235/98 B; 55/385.1, 385.4, 385.6, 467; 209/534

[56] References Cited

U.S. PATENT DOCUMENTS

| | | | |
|---|---|---|---|
| 2,805,825 | 9/1957 | Jorgensen et al. | 235/98 R |
| 3,369,348 | 2/1968 | Davis | 55/374 |
| 4,215,811 | 8/1990 | Kokubo et al. | 235/98 K |
| 4,248,162 | 2/1981 | Skeist | 55/385 R |

*Primary Examiner*—L. T. Hix
*Assistant Examiner*—Eddie C. Lee
*Attorney, Agent, or Firm*—Fisher, Christen & Sabol

[57] ABSTRACT

A roller-type bill counter comprising a counter body having, at the front thereof, an upper bill inlet opening and a lower bill outlet opening, and a frictional plate disposed within said counter body and adapted to frictionally contact with and lead each bill to be counted from said upper bill inlet opening to said lower bill outlet opening. In accordance with the present invention, the bill counter comprises a shield plate mounted on the upper portion of the lower bill outlet opening, in order to prevent the generated dust and stench from being discharged through the lower bill outlet opening. A plurality of apertures perforated through the frictional plate. A fan mounted on the bottom of the counter body in order to suck the dust and stench through said apertures of the frictional plate. An air-permeable fabric filter pocket separately mounted, at the upper end, on the discharging end of said fan and adapted to collect the dust therein.

1 Claim, 2 Drawing Sheets

ROLLER-TYPE BILL COUNTER WITH A DEVICE FOR REMOVING DUST

BACKGROUND OF THE INVENTION

1. Field of The Invention

The present invention relates to a roller-type bill counter, and more particularly to a roller-type bill counter with a device for removing dust and stench.

2. Description of The Prior Art

Conventionally, such type of a bill counter has a frictional plate and a roller having a plurality of blades mounted on the outer round surface thereof, so that when counting bills, the frictional plate fractionally contacts with them and the roller turns them, thereby causing dust, foreign substances, and stench to be generated from bills. These dust and stench are discharged through a front bill outlet opening, together with the counted bills. As a remelt, users may frequently intake the generated dust and stench. Thus, the use of such type of conventional bill counter is insanitary and inconvenient.

SUMMARY OF THE INVENTION

Therefore, an object of the present invention is to provide a roller-type bill counter with a device for removing the generated dust and stench, in order to overcome the above-mentioned disadvantages encountered in the prior art.

In accordance with the present invention, this object can be accomplished by providing a roller-type bill counter comprising a counter body having, at the front thereof, an upper bill inlet opening and a lower bill outlet opening; a frictional plate disposed at interior of said counter body and adapted to frictionally contact with and lead each bill to be counted from said upper bill inlet opening to said lower bill outlet opening; and a roller disposed at the downward end of said frictional plate and provided, at the outer round surface thereof, with a plurality of blades each adapted to carry each counted bill to the lower bill outlet opening, characterized by further comprising a shield plate mounted on the upper portion of the lower bill outlet opening and adapted to avoid the generated dust and stench to be discharged through the lower bill outlet opening; a plurality of apertures perforated through the frictional plate; a fan mounted on the bottom of the counter body and adapted to suck the dust and stench through said apertures of the frictional plate; and an air-permeable fabric filter pocket separablely mounted, at the upper end, on the discharging end of said fan and adapted to collect the dust therein.

BRIEF DESCRIPTION OF THE DRAWINGS

Hereinafter, the present invention will be more described in conjunction with the annexed drawings.

DETAILED DESCRIPTION OF THE PREFERRED EMBODIMENT

Figure 1:
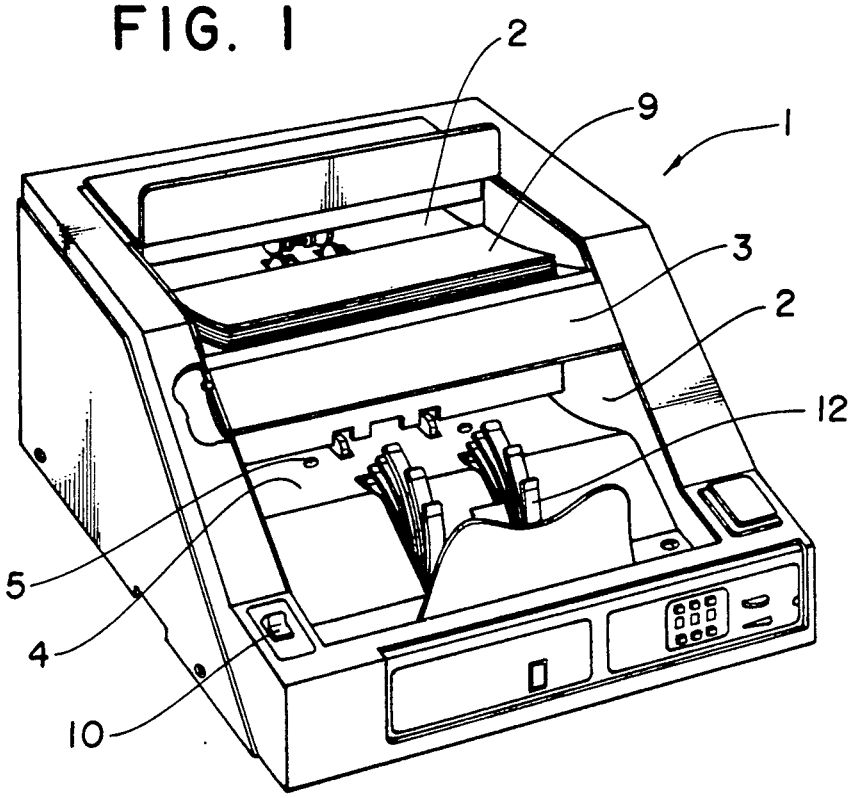
FIG. 1 is a partially-sectioned perspective view of a roller-type bill counter in accordance with the present invention.

Referring to FIG. 1, there is shown a roller-type bill counter in accordance with the present invention. The roller-type bill counter comprises a counter body 1 having, at the front thereof, an upper bill inlet opening 2' and a lower bill outlet opening 2. In the counter body 1, frictional plates 4 and 4' are disposed. The frictional plates 4 and 4' are adapted to frictionally contact with and lead each bill 9 to be counted from the upper bill inlet opening 4' to the lower bill outlet opening 4. At the downward end of the frictional plate 4, a roller 11 is disposed, which is provided, at the outer round surface thereof, with a plurality of blades 12 each adapted to carry each counted bill 9 to the lower bill outlet opening 2. When bills 9 pass through the bill counter, dust, foreign substances, and stench are generated from the bills 9.

Figure 2:
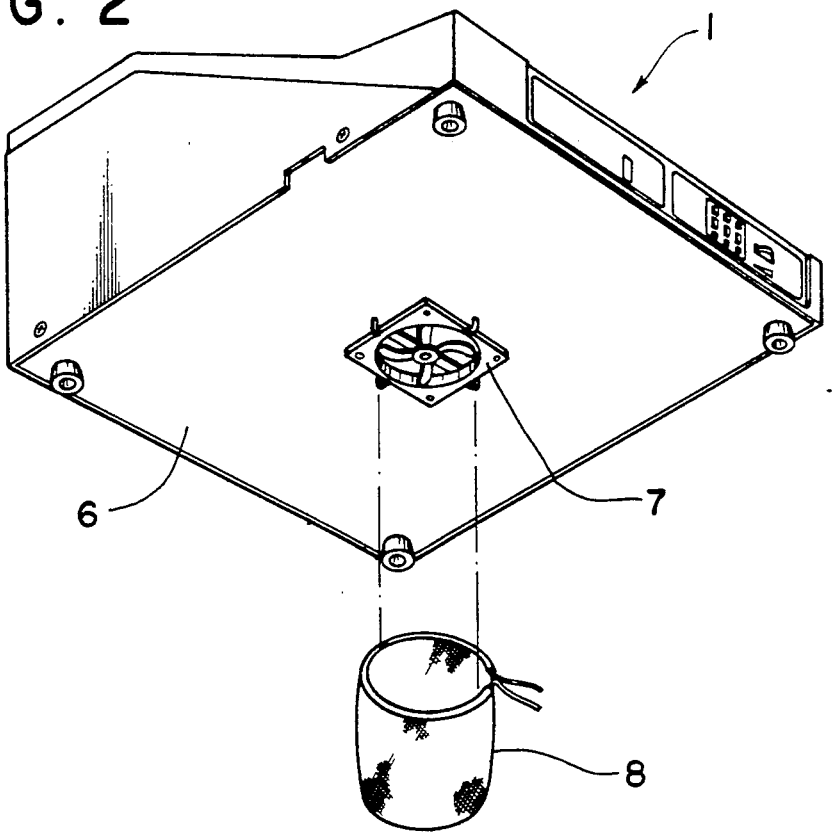
FIG. 2 is a partially-exploded perspective view showing the bottom of the bill counter shown in FIG. 1, from which a filter pocket is being separated.
Figure 3:
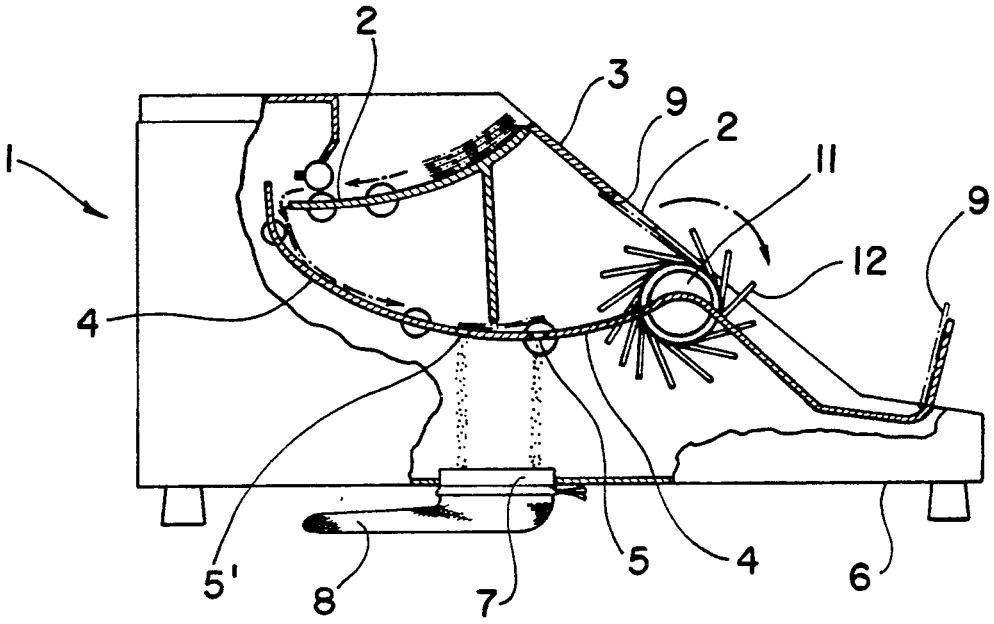
FIG. 3 is a partially-sectioned side view of the bill counter shown in FIG. 1.
Figure 4:
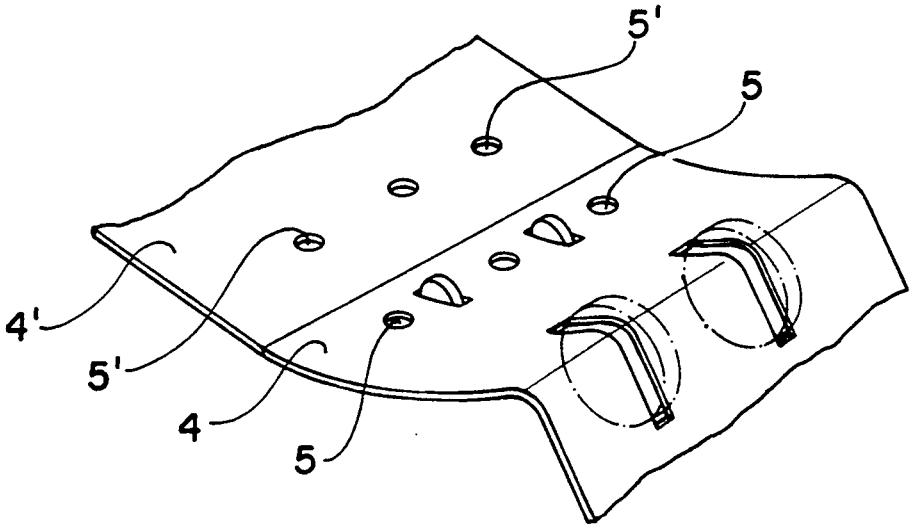
FIG. 4 is a perspective view showing a part of frictional plate of the bill counter shown in FIG. 1.

In order to avoid the generated dust, foreign substances, and stench to be discharged through the lower bill outlet opening, a shield plate 3 is mounted on the upper portion of the lower bill outlet opening 2, in accordance with the present invention. Also, a plurality of apertures 5 and 5' are perforated through the frictional plates 4 and 4', respectively, as shown in FIG. 4. As shown in FIGS. 2 and 3, a fan 7 is mounted on the bottom of the counter body 1, in order to suck the generated dust, foreign substances, and stench through apertures 5 and 5' of the frictional plates 4 and 4'. As shown in FIG. 2, an air-permeable fabric filter pocket 8 is separablely mounted, at the upper end thereof, on the discharging end of said fan 7, in order to collect the dust and foreign substances therein.

In FIG. 1, reference numeral "10" designates a power switch.

Operation of the bill counter of the present invention will now be described.

In order to operate the bill counter, a cord (not shown) is connected to a power source. Then, bills 9 to be countered are placed on the bill inlet opening 2. When the switch 10 is ON under this condition, the bills 9 pass through the frictional plates 4 and 4', so as to be frictionally counted. Thereafter, the counted bills are discharged from the bill outlet opening 2. As mentioned hereinbefore, the bills 9 may generate dust, foreign substances, and stench, during passing through the frictional plates 4 and 4'. In accordance with the construction of the present invention, these dust, foreign substances, and stench can hardly be discharged through the bill outlet opening 2, together with the bills 9, in virtue of the provision of the shield plate 3 on the bill outlet opening 2. The generated dust, foreign substances, and stench are downwardly discharged through the apertures 5 and 5' of the frictional plates 4 and 4' to the filter pocket 8, in virtue of the suction of the fan 7. The dust and foreign substances are corrected in the filter pocket 8, while stench is vent through the filter pocket 8 to atmosphere, in virtue of the air permeability of the filter pocket 8.

As apparent from the above description, the dust, foreign substances, and stench generated during counting bills can hardly be discharged through the bill outlet opening in the bill counter of the present invention, as compared with the prior art, thereby preventing users to directly intake them the bill counter of the present invention. Thus, the bill counter of the present invention is a sanitary and convenient device.

Although the preferred embodiment of the invention has been disclosed for illustrative purposes, those skilled in the art will appreciate that various modifications, additions and substitutions are possible, without departing from the scope and spirit of the invention as disclosed in the accompanying claim.

What is claimed is:

1. A roller-type bill counter comprising a counter body, having a front, having, at the front thereof, an upper bill inlet opening and a lower bill outlet opening; a frictional plate, having a downward end, disposed at interior of said counter body and adapted to frictionally contact with and lead each bill to be counted from said upper bill inlet opening to said lower bill outlet opening; and a roller, having an outer round surface, disposed at the downward end of said frictional plate and provided, at the outer round surface thereof, with a plurality of blades each adapted to carry each counter bill to the lower bill outlet opening. having an upper portion, characterized by further comprising:

a shield plate mounted on the upper portion of the lower bill outlet opening and adapted to avoid generated dust and stench to be discharged through the lower bill outlet opening;

a plurality of apertures perforated through the frictional plate;

a fan, having a discharge end, mounted on the bottom of the counter body and adapted to suck the dust and stench through said apertures of the frictional plate; and an air-permeable fabric filter pocket, having an upper end, separately mounted, at said upper end, on the discharging end of said fan and adapted to collect the dust therein.

* * * * *